United States Patent [19]

Tindall

[11] Patent Number: 4,886,680

[45] Date of Patent: Dec. 12, 1989

[54] COATING OF WEB MATERIALS

[75] Inventor: John D. Tindall, West Yorkshire, England

[73] Assignee: John Waddington PLC, Leeds, England

[21] Appl. No.: 240,079

[22] Filed: Sep. 2, 1988

Related U.S. Application Data

[63] Continuation of Ser. No. 8,990, Jan. 30, 1987, abandoned.

[30] Foreign Application Priority Data

Feb. 1, 1986 [GB] United Kingdom ..... 8602510

[51] Int. Cl.[4] ..... B05D 3/12

[52] U.S. Cl. ..... 427/8; 427/179; 427/208.4

[58] Field of Search ..... 427/54.1, 208.4, 179, 427/8, 172

*Primary Examiner*—Bernard Pianalto

*Attorney, Agent, or Firm*—Klauber & Jackson

[57] ABSTRACT

The invention provides a coating method and machine for applying pressure sensitive adhesive to one side of a web and release material in the form of a silicone coating to the other side of the web. The web is printed in rows of labels and is cut into the rows before being wound up after the coating process. The machine can also be used for transfer coating the adhesive onto the web by passing a release web through the adhesive applicator. Also, the machine can be used for making laminated webs. The machine has novel constructions of adhesive and silicone aplicators and curing devices.

3 Claims, 9 Drawing Sheets

COATING OF WEB MATERIALS

This is a continuation of application Ser. No. 008,990, filed Jan. 30, 1987 now abandoned.

This invention relates to the coating of web materials, and in the general aspects of the invention the web materials may comprise fibrous materials such as paper, or non-fibrous materials such as plastics, or laminates of these materials, although in specific aspects of the invention only materials of a particular form are involved.

The various inventions as disclosed herein arise as a result of development in the field of the manufacture of labels having at least one adhesive side, and which are applicable for example to packaging containers such as cans, bottles and boxes which may be metallic, plastics and/or cardboard in nature, but it will be appreciated that at least some of the aspects of the invention have wider application insofar as the inventions disclosed herein concern the application of coatings to webs, and whilst the preferred end use may be to produce labels in such webs, this is not an essential characteristic of all aspects of the invention.

For the purposes of simplicity of explanation, the expression "base material" will be used to describe the web to which the coating or coating is or are applied.

The development work which has led to the present inventions is directed to the provision of the base material with labels provided on one side with an adhesive, and which can be coiled into roll form without requiring a conventional backing sheet defining a release characteristic surface applied to the adhesive side of the base material. It is is not new to provide a roll of base material with adhesive on one side and with no backing sheet, but no satisfactory method has been provided for the production of such a roll of material having a pressure sensitive adhesive on one side of the base material, and the present invention in one of its aspects provides for such a method.

For the provision of a roll of base material having pressure sensitive adhesive on one side thereof, if no backing sheet is to be provided, then the other side of the base material must embody or be provided with a release coating characteristic surface in order that the roll of material will unroll satisfactorily. Base materials having an inherent release characteristic, such as PTFE, (polytetrafluroethylene) are expensive and are unlikely to be used as base materials for production of adhesive labels, and therefore it is more likely that a coating of release material will be applied to the reverse side of the base material. The most commonly used base material would normally be paper as it is inexpensive, and furthermore it is highly receptive to printing inks, and the technology of printing on paper is highly developed.

The application of pressure sensitive adhesive to a base material web of paper however presents considerable difficulties, and the common method of applying the adhesive is to transfer coat same onto the paper i.e. to apply the adhesive to a robust carrier web and then to apply the paper web to the adhesive side of the carrier web so that the adhesive transfers from the carrier web to the paper web.

In accordance with one aspect of the present invention, there has been devised a method for the continuous coating of base material with pressure sensitive adhesive, enabling the method to be used in connection with fibrous webs such as paper, and in accordance with this aspect of the invention, the adhesive is applied in liquid form (e.g. water based or solvent based) as a film to one side of the base web as the base web moves through an applicator machine, coupled with the use of an automatic control for controlling the tension in the web as it passes through the machine, such control being set so that any weakening effect in the tensile strength of the web as a result of the application thereto of the liquid adhesive will not lead to breakage of the web, and the process further including drying the adhesive after application to the web, to produce a pressure sensitive adhesive film on one side of the web.

One of the difficulties in the application of solvent or water based pressure sensitive adhesive film to a paper web is that the water or solvent in the adhesive film when applied soaks the paper fibres and reduces the tensile strength of the web, but this difficulty is overcome by embodying a tension control in the feeding system for the web to ensure that the web tension is maintained at a level which will not result in breakage of the web as it passes through the application and drying stages of the machinery.

The tension control device may comprise a movable roller having load sensors coupled thereto so that when the tension in the web increases above a pre-determined level, the load sensors will indicate this and cause the roller to be displaced in a direction reducing the tension in the web, and vice versa.

The web tensioning device may be upstream of the applicator station of the machine, and there will of course be a drive unit pulling the web through the machine, downstream of the drying station.

When the base material web, with pressure sensitive adhesive on one side thereof is to be wound into roll form without any backing web, it is necessary to ensure that either the base material has an inherent release characteristic, which means using expensive material, or more usually, the other side of the base material has to have a coating of release material applied thereto.

In accordance with another aspect of the invention, the invention provides a method of applying a release coating to a web of base material.

The release coating which is applied to the base material in accordance with the second aspect of the present invention comprises a release coating of ultraviolet cured silicone composition.

It is known to apply ultra-violet cured silicone coatings to webs to provide such webs with a release characteristic, and the known method is used for example in the production of rolls of adhesive tape such as the adhesive tape sold under the trade mark Sellotape, but such methods require expensive application and curing equipment and do not achieve the production speeds necessary, for example, to make the use of such methods viable in the production of self-adhesive paper labels.

In the present development there was a need for effecting fast and efficient cure of the ultra-violet curable silicone release composition after application of same, and the present invention achieves this objective by providing that in accordance with this aspect of the invention, ultra-violet curable silicone release composition is applied to one side of a moving base web, and subsequently is cured at a curing station by means of ultra-violet lamp means, characterised in that the web passes through an enclosure wherein it is subject to the ultra-violet rays, and said enclosure is flushed with an inert gas such as nitrogen which provides effective curing of the release composition.

It has been found that satisfactory cure could not be effected without the inert gas atmosphere, and specifically we have used nitrogen with good effect. In a typical example, a film of ultra-violet curable silicon applied in the quantity of 1.5 grammes per square metre to the web was cured by means of lamps applying ultra-violet radiation to the web through a quartz glass to filter out the infra-red radiation, whilst the web was traveling through the enclosure at a speed of 50/100 meters per minute.

The said enclosure is preferably defined on one side by means of the said quartz glass which isolates the ultra-violet curing sources from the interior of the enclosure through which the web passes, and at the side of the enclosure opposite the quartz glass, there preferably is a water cooled heat sink serving to remove heat from the enclosure atmosphere. The web passes through two slits at opposite sides of the enclosure, and preferably air is circulated over the ultra-violet sources in order to cool same.

This method of applying an ultra-violet coating can be applied of course to any suitable base material, as indeed can the aspect of the invention relating to the application of pressure sensitive adhesive, but in a preferred arrangement, the ultra-violet release coating and the application of pressure sensitive adhesive take place in sequence on the same web of base material, which is typically a web of paper pre-printed to define labels therein, the release coating being applied over the side of the web on which said labels are printed. If the web is of a transparent material, then the printing can of course be applied in reverse to the side of the web to which the adhesive is applied.

In a composite machine for performing the ultra-violet release coating application, and the application of pressure sensitive adhesive, the machine may have additional units enabling the feed and take-up of the base material, so that the material can be fed through a machine on a continuous basis. Thus, the machine may include an unwinding unit leading the base material to the release coating application station, followed by the UV curing station, and from the UV curing station the base material may pass over the said tension control roller, and from the tension control roller the base material having the UV cured silicon release coating on one side thereof passes to the adhesive applicator station whereat adhesive is applied to the other side of the web, and from the adhesive application station the web passes through the drying station in which the adhesive is dried so as to provide a pressure sensitive adhesive on the said other side of the web. The web may then be trimmed at the edges, slit and spread into individual webs of labels, if multi rows of labels are printed on the web, and finally wound into reels of labels on a take-up unit. The take-up unit may suitably involve a flying splice machine enabling the winding of the coated material into rolls continuously without having to stop the feed of the base material through the machine.

As the machine is provided with the facility for applying a release coat of silicone and for curing same, and also with the facility for applying adhesive and drying same, the machine can be adapted for producing adhesive coated base material webs by the transfer coating process wherein the base material web, typically paper has the release coating applied thereto and then cured, but instead of this base material passing through the adhesive coater it by-passes same. A carrier web of a type more capable of withstanding the application of the adhesive and the drying of same passes through the adhesive applicator and has adhesive applied thereto, which is subsequently dried and then the carrier web and base web are brought together so that the adhesive layer on the carrier web is applied to the opposite side of the base web from that to which the release coating has been applied, so that the adhesive transfers from the carrier web onto the base web. The carrier web is then re-reeled, whilst the base web with the adhesive on one side and release coat on the other side can be wound at the re-wind unit.

Additionally, the machine can be adapted so that it can produce the conventional laminated arrangement comprising a base material web defining labels which is wound with a backing web, and in this case, the UV silicone coating station and curing station are not used in that the release web which is a silicone coated web has the adhesive applied thereto by being passed through the adhesive applicator station and drying station, and then the base web on which the labels are printed is simply brought into laminated contact with the adhesive side of the release web, and the laminated webs are wound together into a roll.

The transfer coating utilisation of the machine as described herein is suitable when the base material is of a nature rendering it unsuitable for passing through the adhesive applicator and dryer. For example the base material may be of a nature which would shrink or expand as it passes through the dryer, or it may be of such a flimsy character that is would be unable to withstand the wetting effect which happens when the adhesive is applied thereto. The transfer web as it does not form part of the finished product, and is reused, can be made of such characteristic to withstand the adhesive application and drying.

The machine is used for the production of reeled material in laminated form comprising a backing web and a base material web when the customer has conventional equipment for handling such laminated web. Such equipment comprises, for the manufacture of labels, a device for cutting through the base material web to define the peripheries of the labels, followed by a device for stripping the skeletal exterior of the base material from the laminated web leaving the individual labels on the carrier web, which subsequently is re-reeled to provide a row of individual labels spaced apart on but peelable from the carrier web.

Various aspects of the invention, and in particular embodiments thereof, will now be described, by way of example with reference to the accompanying drawings, wherein:

DETAILED DESCRIPTION OF THE DRAWINGS

Figure 1:
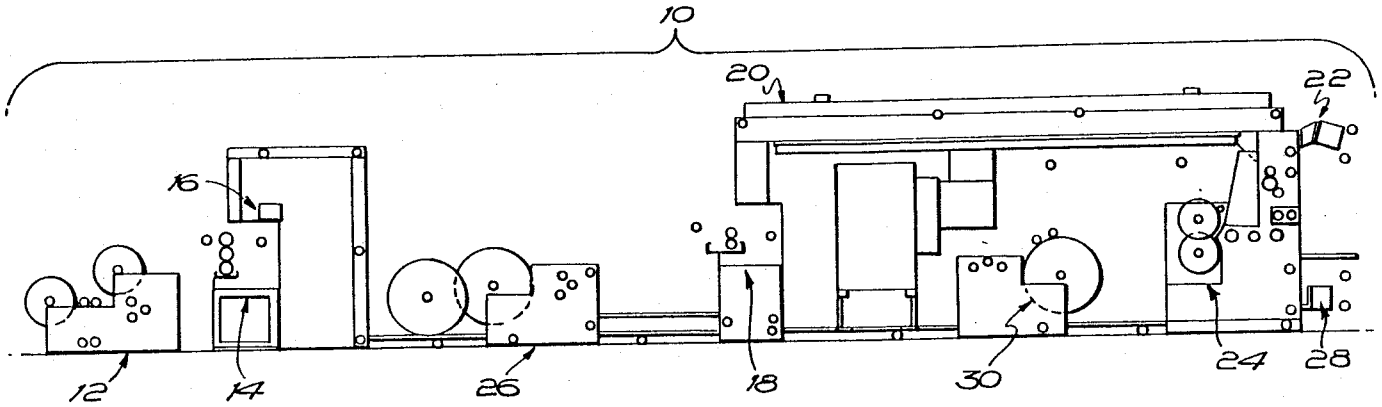
FIG. 1 is a diagrammatic side view of the arrangement of the machine according to an embodiment of the invention.

Referring to the drawings, and firstly to FIG. 1, the machine 10 illustrated is for applying a silicone coating to one side of a base material web, and an adhesive coating to the other side of the base material web, so that the resulting web can be rolled into a reel, or several reels as will be explained hereinafter, without requiring the use of a separate backing web.

The machine comprises a number of stages being a unwind unit 12, a silicone coating unit 14, an ultra-violet curing unit 16 for curing the silicone as applied at unit 14, an adhesive coating unit 18, for applying to the opposite side of the web a coating of pressure sensitive adhesive composition in liquid form, a drying unit 20 for the radio frequency drying of the adhesive composition, an edge guide unit 22 for maintaining the web accurately whose path of travel will be seen, and a rewind unit 24 for winding up the coated material into rolls.

The machine has an additional unwind unit 26 being a single reel unwind unit for a purpose to be explained, and an additional edge guide unit 28. Additionally, there is a silicone release web rewind unit 30 also for a purpose to be explained.

The machine has various guide rollers which are indicated in FIG. 1, and those which are significant will be explained in more detail.

Figure 2:
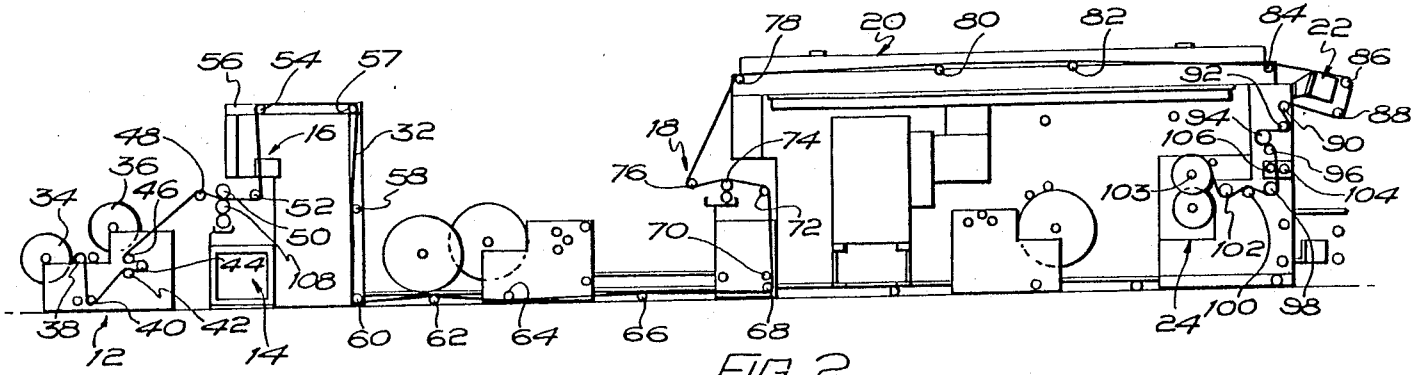
FIG. 2 is a view similar to FIG. 1, but showing the passage through the machine of a layer of base material which is coated in opposite sides with a release material and an adhesive.
Figure 4:
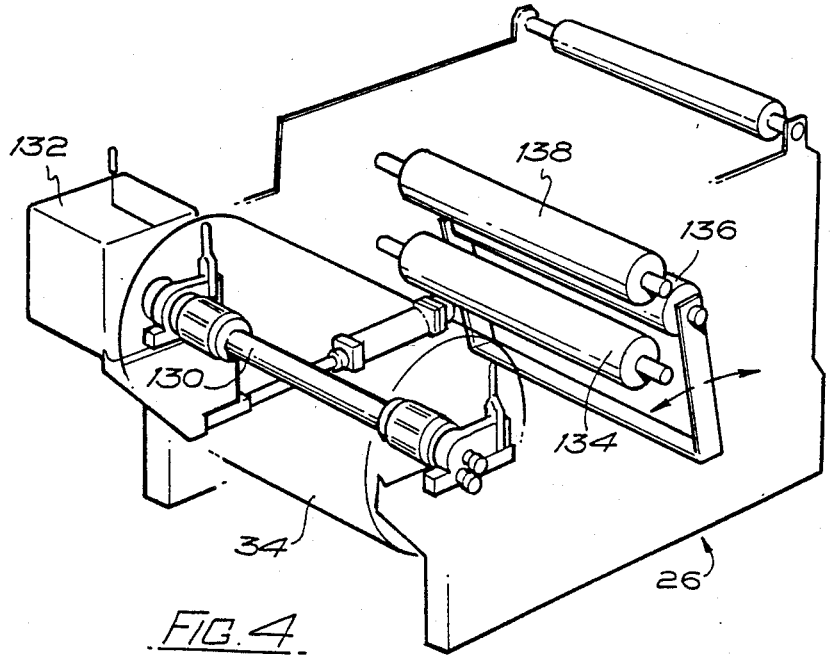
FIG. 4 shows a view similar to FIG. 3, but illustrates a single reel unwind unit.

FIG. 2 shows the machine of FIG. 1 when it receives a roll 34 of base material web 32. The material is supplied in basic reel form as shown in FIG. 4, and is carried by one axle of the unwind unit 12. Another axle carries a spare roll 36 of the stock of material. The material 32 preferably is printed so as to define side by side rows of individual labels, and preferably the web 32 is perforated so as to define pairs of sprocket holes to each side of each row of labels so that eventually, as will be explained hereinafter, when the web 10 is slit longitudinally into the individual strips of labels, each strip will have sprocket holes at the edge thereof for the subsequent driving of the label web through a label applicator machine.

The web 32 from the reel 34 travels over rollers 38, 40 42, 44 and 46 of the unwind unit, and then it travels over rollers 48, 50 and 52 of the silicone coating unit 14. From the coating unit the web 32 passes through the ultra-violet curing unit 16, and then over a roller 54 on the machine framework 56. The web 32 travels over guide rollers 57, 58, 60, 62, 64, 66, 68 and 70 until it reaches an input roller 72 of the adhesive coating unit 18. It passes over an application roller 74 of the adhesive coating unit 18, and then over an output roller 76 of adhesive unit 18.

As the web passes through the dryer 20 it is guided by rollers 78, 80, 82 and 84 before reaching the edge guide unit 22 and in its passage through this guide unit 22 it passes over rollers 86 and 88.

The web then passes over various guiding drive rollers 90, 92, 94, 96, 98, 100 and 102 before reaching the first take up shaft 102 of the rewind unit 24.

A pair of nip rollers 104 and 106 serve to pull the web through the machine, and it is also at this point that the web is trimmed if necessary.

The web is also driven by means of the roller 50 at the silicone coating unit 14 where the roller 50 defines a nip with an application roller 108.

These rollers, such as rollers 90, 94, 104 and 100 each of which contacts the adhesive coated side of the web 32, are preferably of a release material such as polytetrafluoroethylene so that the adhesive will not transfer to such rollers.

As will be understood from FIG. 2, in its passage through the machine the web 32 has a release material applied at the silicone coating unit 14, and that coating is cured as the web passes through the curing unit 16. To the opposite side of the web is applied an adhesive at the adhesive coating unit 18, and that adhesive is dried as the web passes through the dryer unit 20, and finally the web coated on respective sides with the adhesive and silicone coating is wound into reel form as indicated by numeral 1 or 2.

Various units of the machine will now be described in more detail.

THE UNWIND UNITS

The machine has two unwind units, namely a two reel unwind unit 12 and a single reel unwind unit 26 as shown in FIG. 1. The single reel unwind unit is not used in the arrangement shown in FIG. 2.

Figure 3:
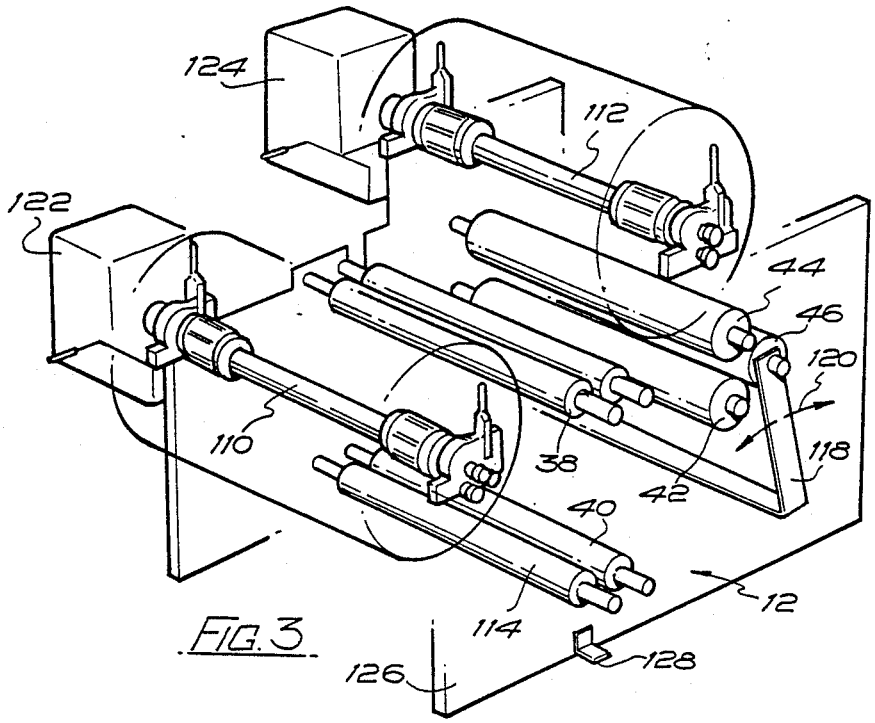
FIG. 3 is a diagrammatic prespective view of a two reel unwind unit as used in the machine of FIG. 1.

Referring to FIG. 3 the two reel unwind unit 12 is shown, and will be seen to comprise two shafts 110, 112, each of which carries a roll of the basic stock material 32. The unit comprises a pair of nip rollers namely the previously described roller 40, and parallel roller 114 and upper guide rollers 38 (wherein described) and roller 116.

The three rollers 42, 44 and 46 illustrated in FIG. 2 are also shown, and it will be seen that roller 46 is a tension roller in that it is carried by a pivotable frame 118 which can be pivoted as indicated by arrows 120 so as to move the roller 46 further from or closer to the roller pair 42, 44 thereby to control the tension in web 32.

Each of the shafts 110, 112 is fitted with a pneumatic brake 122, 124 and the various rollers and shafts illustrated are mounted on a robust steel frame 126. The brakes 122 and 124 introduce a small amount of drag into the system, thereby preventing the rolls of material from overrunning the feed and keeping the material taut at all times. A tension roller controls the baking effort automatically in that depending upon tension in the web 32, so the roller 46 will be swung further towards or away from the roller pair 42, 44, and the swing of the roller 46 through a feedback control, keeps the tension of the unwind web constant by adjustment of the pneumatic brake 122 or 124 depending upon which is operational.

During normal operation two rolls of material are loaded on the unwind unit 12 on the respective shafts 110 and 112, and at any one time one of the rolls will be being fed through the machine whilst the other one will be a reserve roll. The shaft which is operational will be braked by the associated pneumatic brake 122, 124 whilst the other pneumatic brake is off. When the roll reaches its end, the machine operator presses a foot switch 128 which initiates a change over sequence and the end of the material on the feed roll which is becoming exhausted is spliced to the beginning of the material on the reserve roll and the braking of the reserve roll is made effective via the associated pneumatic brake whilst the empty roll is unbraked. The operator can then remove the reel core from the exhausted supply and load a new reserve roll on to the empty unwind shaft.

Figure 15:
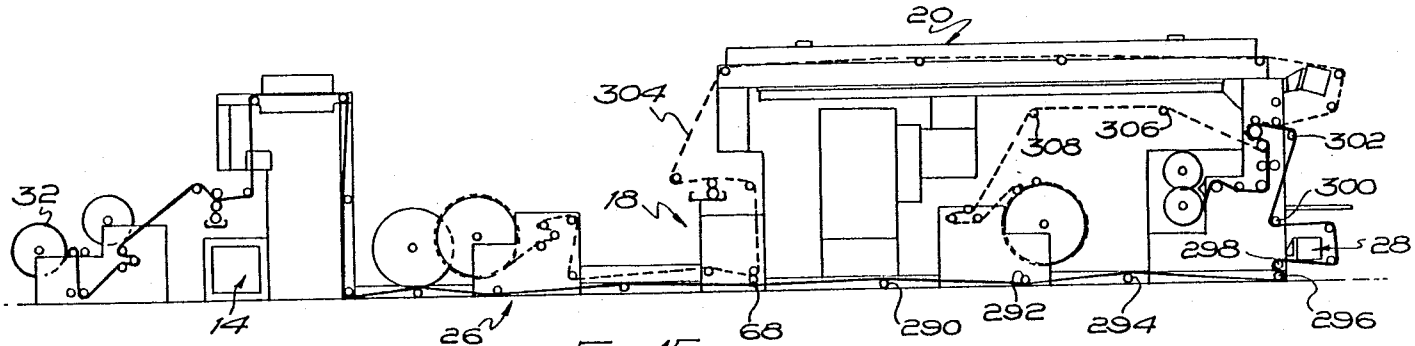
FIG. 15 is a side elevation similar to FIG. 2, but showing the machine in the transfer coating mode of operation.
Figure 16:
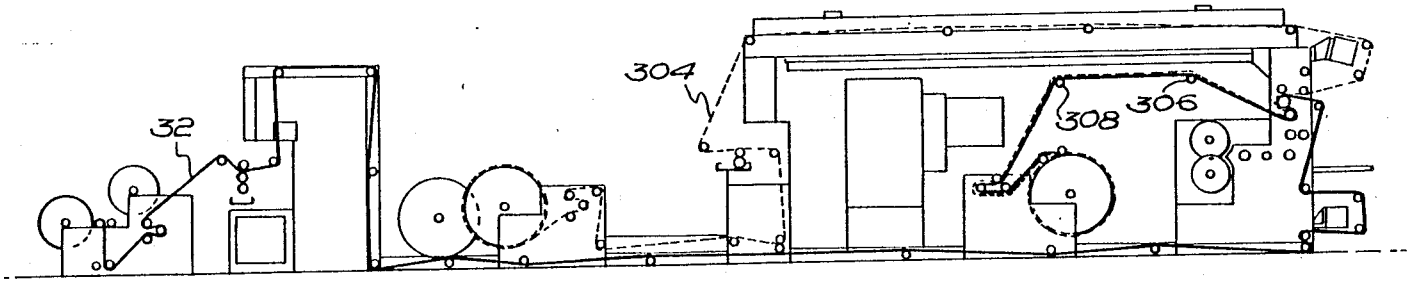
FIG. 16 is a view similar to FIG. 15, but showing the machine in the laminated mode configuration.

The single unwind reel unit 26 shown in FIG. 4 is not used in the operational mode of the machine shown in FIG. 2, but is used in the operational modes as shown in FIGS. 15 and 16.

The single reel unwind unit comprises a single unwind shaft 130 with associated pneumatic brake 132. A cluster of tension rollers 134, 136 and 138 which are constructed and operate similarly to rollers 42, 44 and 46 are included in the unit. The material from the unwind shaft 130 passes over roller 134 around roller 136 and then back over roller 138, for example as shown in FIGS. 15 and 16. During normal operation using the single reel unwind unit the braking effort applied by the pneumatic brake prevents any overrun. When the roll of material gradually exhausts, the operator has to decide when to stop the machine for the purposes of loading into the single unwind unit a new reel of material.

THE SILICONE COATING UNIT

Figure 5:
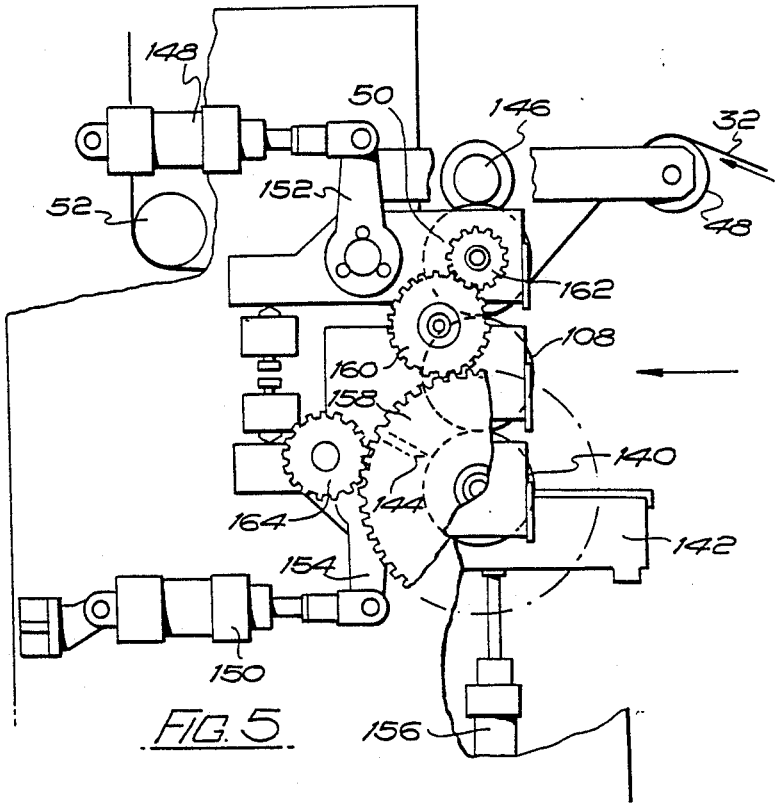
FIG. 5 is a diagrammatic side elevation illustrating the components of the release coating applicator station.
Figure 6:
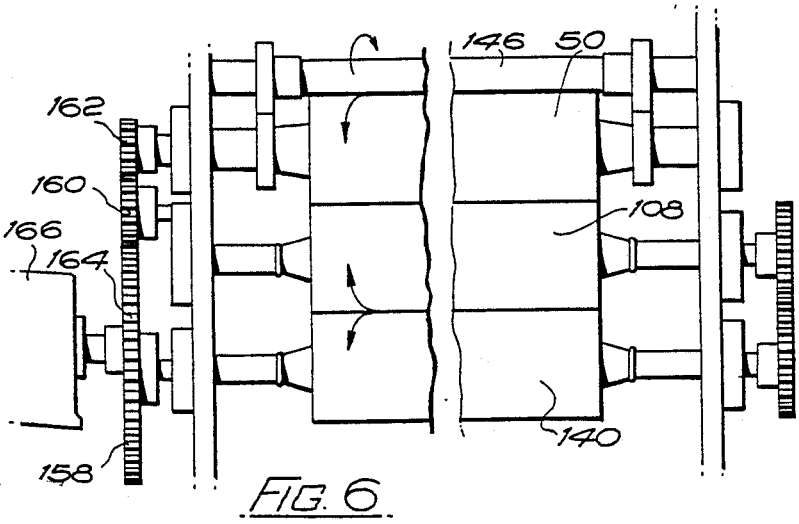
FIG. 6 is an end view looking in the direction of arrow VI of FIG. 5.

FIGS. 5 and 6 show the silicone coating unit, although FIG. 5 is viewed from the opposite side from the view in FIG. 2. The previously described rollers 50 and 108 are clearly shown, as is the path of travel of the web 32 through the silicone coating unit. The roller 108 is the application roller insofar as it is the roller which transfers the silicone coating to the web 32, and the application roller coacts with a gravure roller 140 which dips into a tray 142 containing the silicone composition. An adjustable doctor blade 144 which cooperates with the gravure roller 140 controls the amount of silicone which is picked up by roller 10 and transferred to roller 108, and roller 50 cooperates with a stabilizer roller 146. The rollers 50, 108 and 140 are forced together by means of pneumatic cylinders 148 and 150, the cylinder 148 acting through a lever 152 to urge the impression roller 50 into nipping contact with the roller 108 thereby to form a drive between the rollers 50 and 108, whilst cylinder 150 via a crank 154 loads the gravure roller 140 into pressure contact with the application roller 108. The silicone containing tray can be raised and lowered by means of a raising and lowering cylinder 156.

When the rollers 50, 108 and 140 are forced together by the cylinders 148 and 150, they are also geared together by means of the gears 158, 160 and 162 respectively secured to the shafts of the gravure roller 140, the application roller 108 and the impression roller 50. A drive pinion 164 drivingly engages the gear 158, and the drive pinion, as shown in FIG. 6 is coupled directly to a drive motor 166. The cylinders 148, 150 and 156 can be retracted, for example for the threading up of the machine, so as to remove the rollers 50 and 140 from contact with the roller 108, and also to move the tray 142 clear of the gravure roller 140.

Although not shown, there is a mechanism for reciprocating the doctor blade 144 lengthwise of the gravure roller 140 in order to ensure an even application of the silicone.

The silicone coating unit has the function of controlling the application of silicone to the base material 32, but the unit also performs another function in that it draws the base material from the unwind unit 12 and into the machine.

The rollers 50, 108 and 140 are arranged in self aligning bearings. The impression roller 50 is of crome plated steel, whilst the application roller 108 is rubber covered. The gravure roller 140 is engraved in such a way as to enable a specific weight of silicone coat to be applied to the base material.

The stabilizing roller 146 runs in contact with the impression roll 50.

The air cylinders 150 and 148 are designed and arranged to give automatic "throw off" when the machine stops, which means that they will be automatically retracted from the application roller 108 when the machine stops. Motor 166 is a variable speed DC motor and a tacho-generator is fitted to monitor shaft speeds and to provide a signal for the master control unit illustrated in FIG. 14. In this particular example, the gravure roller is geared to run at one quarter of the surface speed of the impression and applicator roller.

The doctor blade 144 is pneumatically loaded and its angle in relation to the gravure roller is adjustable.

During operation, the nip provided between the impression roller 50 and application roller 108 provides the drive to draw the base material 32 from the unwind system and to feed the material beyond the said nip. The tray 142 is arranged to be approximately half full of silicone and the gravure roller runs partially immersed therein. The silicone is picked up by the gravure roller 140, it transferred to the rubber application roller 108 and from this roller is transferred to the base material 32. The doctor blade 44 is set to control the amount of silicone which is transferred.

ULTRA-VIOLET CURING UNIT

Figure 7:
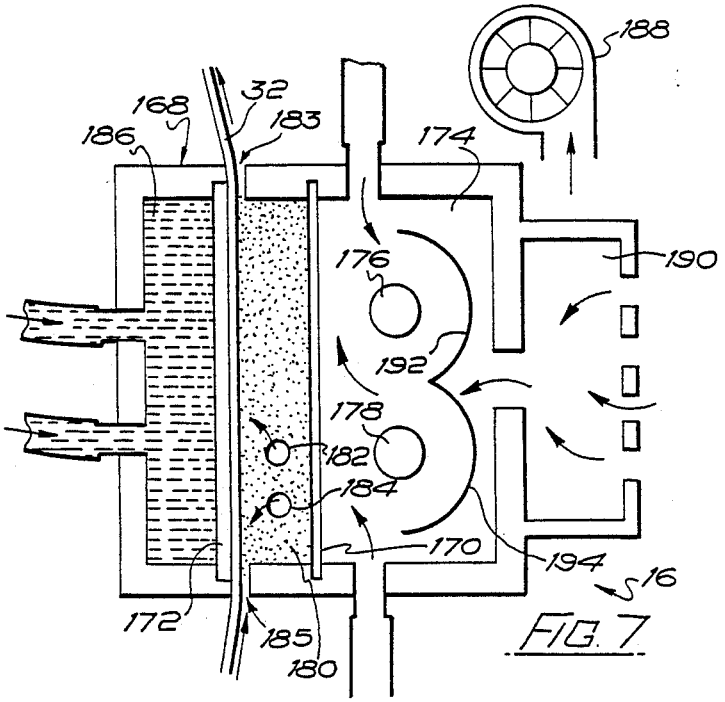
FIG. 7 is a diagrammatic side elevation of the ultraviolet release coating cooling station.

If reference is made to FIG. 7, this drawing shows diagrammatically the ultra-voilet curing unit 16. The unit comprises a box shaped casing 168 which is partitioned by means of a quartz glass window 170 and a steel plate 172, in order to define three chambers 174 being an air chamber containing two ultra-violet lamps 176 and 178, a nitrogen enclosure 180 into which nitrogen is flushed through the inlet pipes 182 and 184 having inlet holes therein, and slots 183, 185 through which the base material 32 passes, and finally a water chamber 186 into which cold mains water is circulated in order to keep the chamber 180 cool. A centrifugal fan 188 draws air through a duct 190 and into the air chamber 174 in order to keep the UV lamps cool.

The quartz window 170 filters out infra red light, but allows ultra-violet to pass therethrough in order to effect the curing of the silicone coating.

The UV lamps 176, 178 are high efficiency lamps and each is fitted with an aluminium reflector 192, 194 to direct the output of the lamps through the quartz window 170 to the nitrogen chamber 180.

Pressure sensors (not shown) are located in the exhaust section of the air duct in order to switch off the lamps 176, 178 automatically in the event of failure of the fan 188.

The slots 183, 185 through which the base material 32 passes are provided with gas seals in order to limit as much as possible nitrogen loss, but the nitrogen does flow throught these slots and the base material in fact runs in contact with the cooled steel plate 172 so that heat will be carried away from the material as curing takes place.

Curing speeds of the order of 50/100 metres/minute may be achieved.

ADHESIVE COATING UNIT

The principle components of the adhesive coating unit are illustrated in FIG. 6. The application roller 74 is shown as are two guide or path rollers 72 and 76. The application roller 74 is located vertically above a trough roller 194, and the application roller 74 and trough roller 194 are geared together by gears 196, 198 respectively secured to the shafts of said rollers. The application roller is carried on a lever arm 200 which is pivotable by means of an air cylinder 202 through a crank 204 connected between the piston of the air cylinder and the lever 200 so that the application roller can be raised clear of the trough roller 194 so as not to pick up any adhesive therefrom when adhesive pick-up is not required.

The path rollers 72 and 76 guide the base material 32 into small arcuate contact with the application roller 74, but each of the path rollers 72 and 76 can be raised and lowered by means of pneumatic cylinders 206 and 208 respectively. Cylinder 206 acts directly on roller 72 to raise and lower same, whilst cylinder 208 acts through a bell crank lever 210.

The function of the adhesive coating unit is to apply an even layer of water based adhesive to the material 32, and although not shown in FIG. 6, there is a tray containing the water based adhesive material and into which the roller 194 dips in order to pick up the adhesive.

Additionally, there are doctor blades 210 for removing adhesive along peripheral rings on the application roller, so that the adhesive will be applied to the web 32 only in desired strip locations. In this connection it has been mentioned that the adhesive is removed from the application rollers so that adhesive will not be applied over the sprocket holes in the base material. As many doctor blades 210 as required will be used for this purpose, depending upon the number of rolls of labels which are formed in the base material 32.

Additionally, there is a meyerbar 212 located at the top of adjustable pedastals 214 so that the meyerbar will contact the adhesive coated surface of the material 32 for a purpose to be explained.

Figure 9:
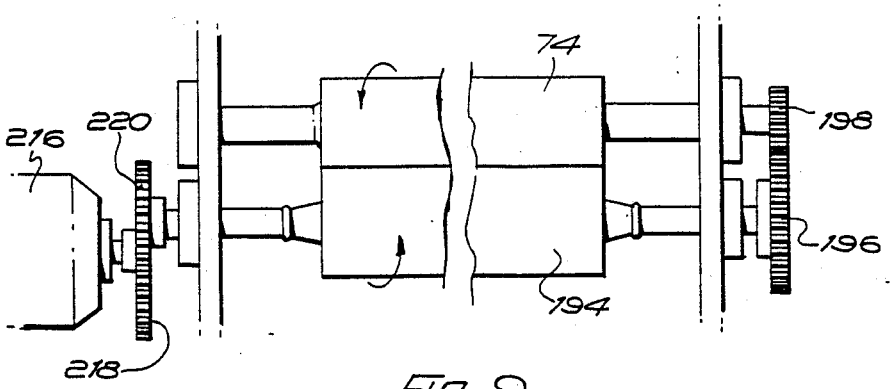
FIG. 9 is a end view of the trough roller and application roller of the adhesive application station.

The trough roller 194 and application roller 74 are directly driven by means of a motor 216 as shown in FIG. 9, which is geared to the shaft of the trough roller 194 by means of gears 218 and 220.

Figure 10:
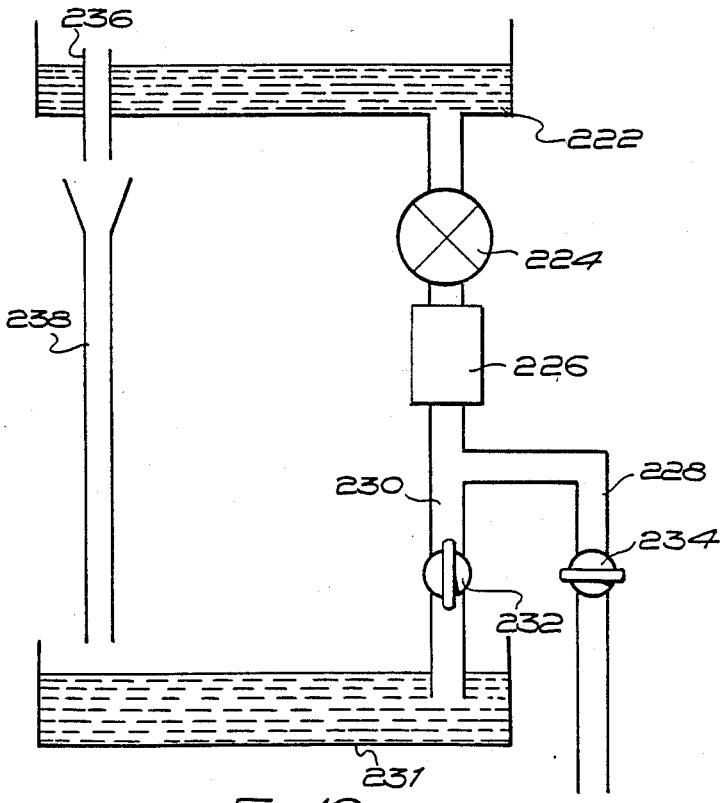
FIG. 10 is a circuit diagram illustrating the adhesive circulation circuit.

The adhesive system for the adhesive coating unit 18 is shown in FIG. 10, and will be seen to comprise a stainless steel tray 222 containing the adhesive and into which the trough roller dips. The tray is equipped with a pump 224, a filter 226, and a pipe system 228 and 230 to enable the adhesive to be replenished during normal operation from an adhesive reservoir 231. The pipe 228 is connected to a water supply to enable the addition of water to the adhesive reservoir, and shut off valves 232 and 234 are provided in the pipes 230 and 228 for control purposes. An overflow 236 from the tray 222 leads to a down pipe 238 which returns overflow adhesive to the adhesive reservoir 231.

The meyerbar 212 controls the amount of adhesive applied to the base material. The meyerbar is a small diameter wire-wound rod (similar in appearance to a threaded bar). The weight of the coat of adhesive applied is directly proportional to the meyerbar wire size and any suitable size of meyerbar may be used depending upon the application. During operation the meyerbar is driven by an air motor and rotates in a direction against the flow of material. This contraflow rotation scrapes off excess adhesive into a tray located under the meyerbar.

Figure 14:
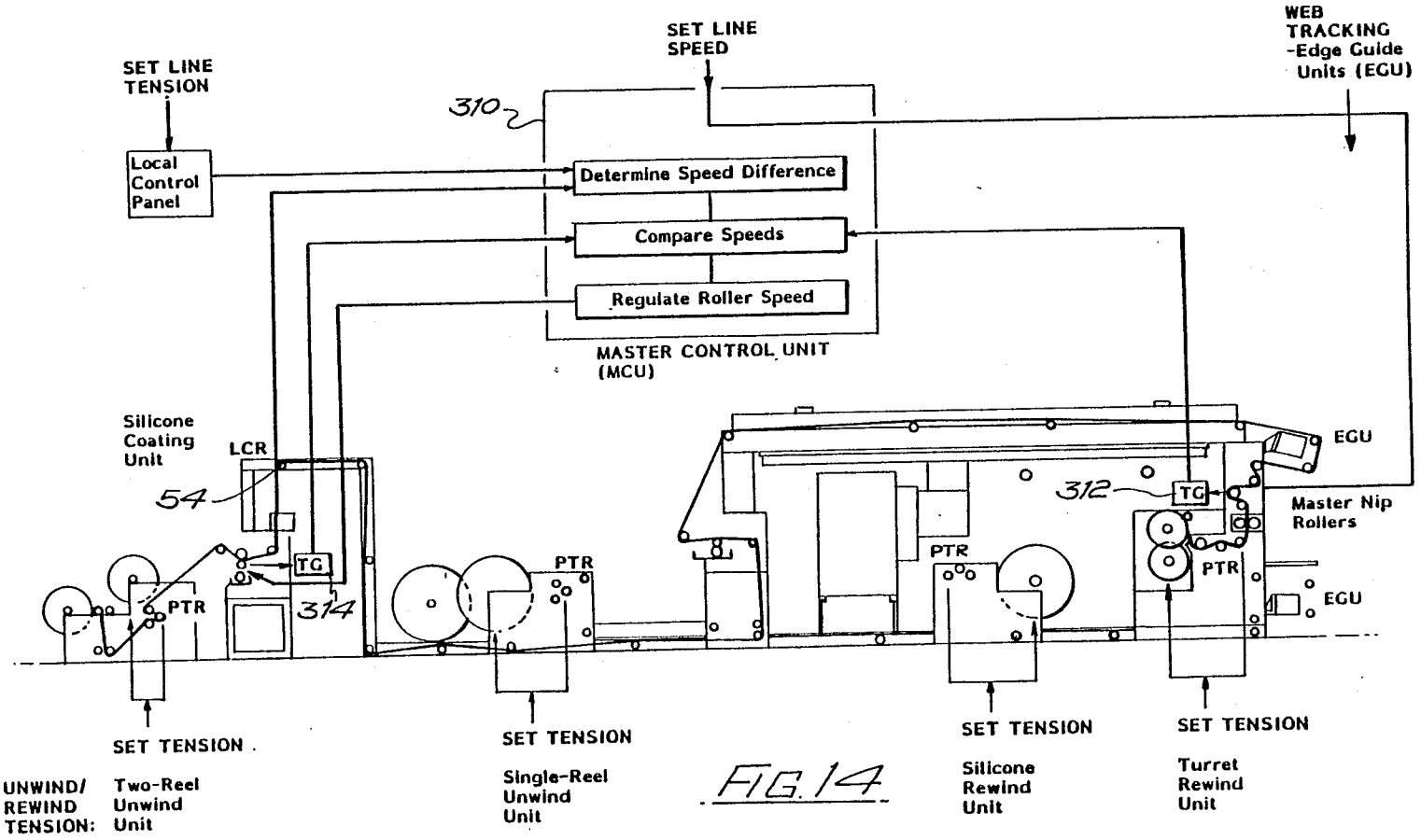
FIG. 14 is a diagrammatic side view of the machine, but illustrating the control system of the machine.

A tacho-generator is used in conjunction with the motor to monitor shaft speeds and to provide a control signal for the control system illustrated in FIG. 14.

Figure 8:
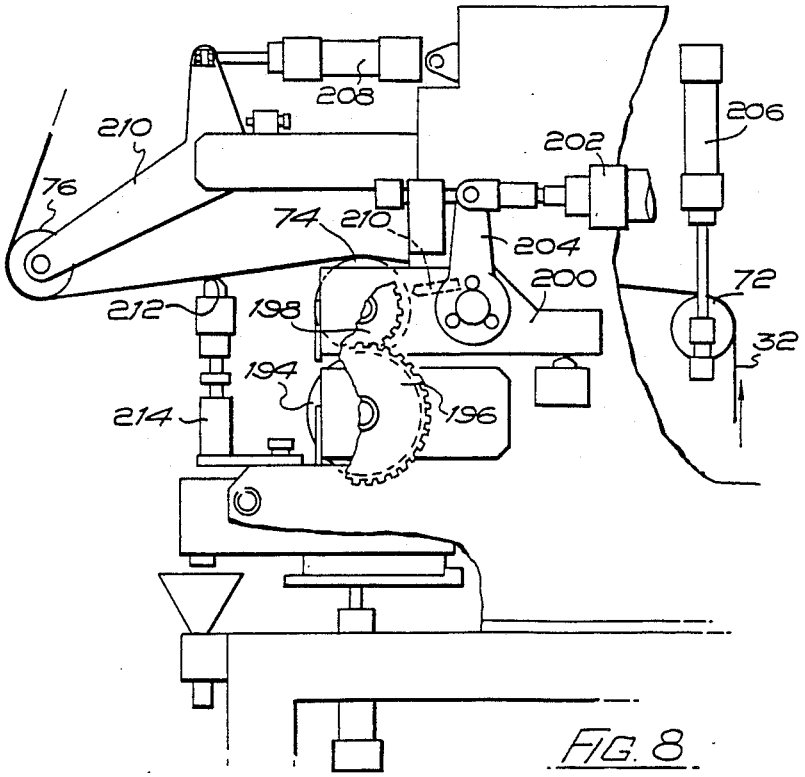
FIG. 8 is a diagrammatic side elevation illustrating the adhesive application station.

During normal operation the tray 222 is half full of adhesive and is in an elevated position. The roller 194 is partially immersed in the adhesive and as it turns it transfers adhesive to the application roller 74. The path rollers 72 and 76 are in a down position allowing the material 32 to run as shown in FIG. 8 in contact with the application roller. As the base material 32 moves through the unit it is charged with adhesive by the application roller 74 and then passes to the meyerbar 212 where the rotating meyerbar removes excess adhesive and the adhesive coated base material continues from the path roller 76 to the radio frequency dryer unit 20.

When it is necessary to stop the adhesive coating operation, the path rollers 76 and 72 raise the material away from the application roller 74. This is achieved by the control system as a two-step function. The roller 72 is raised first, followed by raising of the roller 76. This ensures that all of the adhesive applied to the material 32 is scraped by the meyerbar.

It will be seen that the adhesive unit presents a number of significant features namely that the adhesive is put on by an applicator roller in amounts more than required, and subsequently is scraped by the meyerbar. Additionally, when the operation is to be stopped, steps are taken to ensure that the material is removed from the application roller in a paticular fashion to ensure that all applied is scraped by the meyerbar.

RADIO FREQUENCY DRYER

The radio frequency dryer unit 20 shown in FIG. 1 is, as can be seen, an elongated enclosure or ducting having a rectangular cross section. A platen is housed therein, and a series of hinge lids are fitted along the top of the enclosure to allow easy access to the platen. The platen is a radiation device which is used to apply the radio frequency energy exactly where required, and resembles a large television serial running the length of the interior of the enclosure. This generator produces up to 25 kw of radio frequency operating at 27.12 MHz, and the generator is specifically designed to remove water from water based adhesives carried on a plastic or paper base material 32, without damaging the material. The rollers 78, 80, 82 and 84 are provided to guide and support the base material as it passes through the enclosure.

In the radio frequency dryer, the adhesive coated material 32 is subjected to the radio frequency energy radiated from the platen. This agitates the molecules of the water in the adhesive and vibration of the molecules generates heat causing the temperature of the water to rise. The water evaporates leaving the adhesive dry and the base material undamaged. The water vapour is removed by extraction fans and vented to atmosphere.

EDGE GUIDE UNITS

Figure 11:
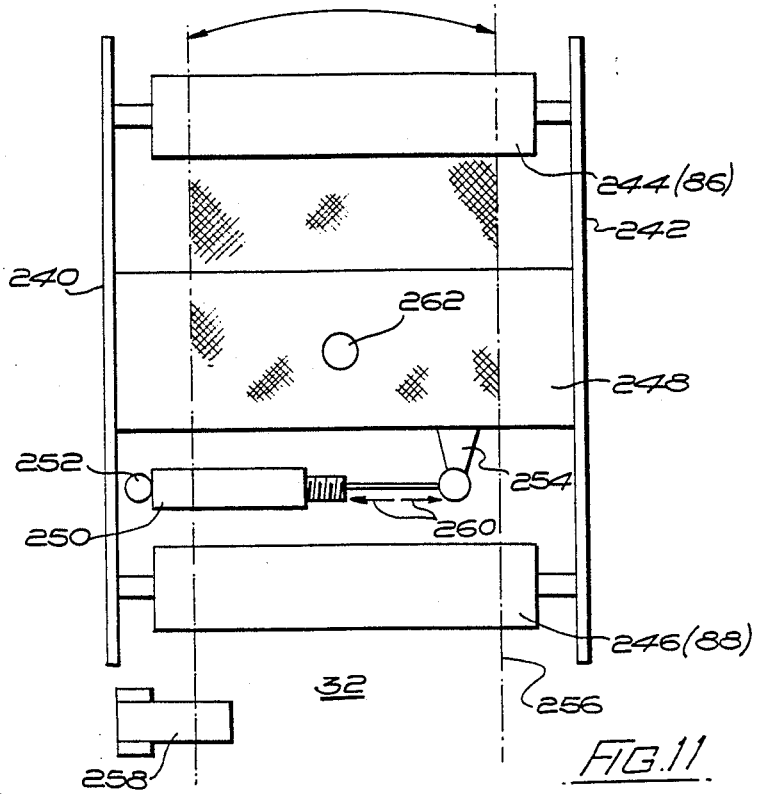
FIG. 11 is a plan view of an edge guide unit of the machine shown in FIG. 1.

The machine shown in FIG. 1 has tow edge guide units 22 and 28 and they operate in similar fashion. FIG. 11 is an end view of an edge guide unit, and it will be seen that the unit comprises a pair of spaced parallel plates 240 and 242 between which extend respectively a top guide roller 244, a bottom guide roller 246 and a tilting frame 248. The rollers 244 and 246 in fact correspond to rollers 86 and 88 as shown in FIG. 2. A geared motor drive 250 is connected between a stationary part of the machine frame 252, and an arm 254 on the revolving frame 248. The path of travel of the web 32 over the top and bottom rollers 244 and 246 is indicated by reference 256. The edge guide unit is used in conjunction with a web edge sensor which in this case is an infra red sensor 258. This sensor is set to detect any wanderings of the web 32 lengthwise of the bottom roller 246 from a pres-set position, and if such lateral wandering is detected, the geared motor drive 250 is actuated so as to expand or contract as indicated by the arrows 260, which causes the edge guide unit to swivel about the frame pivot point 262, which has the effect of returning the base material 32 to a path of travel through the machine which is the optimum path of travel.

END ROLLERS

The rewind unit 24 and the silicone rewind unit 30 are associated with a group of end rollers best shown in FIG. 19, which also shows the edge guide unit 22 described above.

In FIG. 19, the material 32 is shown as taking a path through the end rollers when the machine is in the backingless label mode as shown in FIG. 2.

The end rollers comprise the path rollers 90 and 92, a master nip roller 94, a further path roller 96, slitting rollers 104 and 106, a tension roller 98, a bowed roller 100, a crease removing roller 103 and a path roller 102 from which the material passes to the turret rewind unit.

The path rollers simply guide the material through the roller units.

The master nip rollers 94 and a corresponding roller 264 draw the material through the machine from the silicone coating unit, and these nip rollers in fact comprise three rollers 94, 96 and 264 arranged vertically. The centre and bottom rollers 94 and 96 are driven and the top roller 264 runs free. The surface speed of the bottom roller 96 is approximately 1% greater than that of the centre roller 94. This speed differential ensures that the adhesive coated material peels cleanly off the centre roller 94, as the adhesive coated material must be prevented from tracking round with the surface of the roller 94. The pressure between the rollers 94, 96 and 264 is applied by manually operating screws. The pressure screws usually only require adjustment during the setting up of the machine. The speed of the driven rollers is regulated from a main control panel.

The slitting rollers 104 and 106 cut the base material 32 into widths as required, and the slitting rollers define disc shaped cutters running against a steel roller. Cutter pressure is applied pneumatically and is set at a central control desk.

The tension roller 98 regulates the speed of the turret rewind unit 24 and will be described hereinafter.

The bowed roller 100 is a curved or barrel shaped roller, the function of which is to part or spread the strips of the base material 32 for winding onto spaced cores on the rewind unit. As the strips located side by side pass over the bowed roller, so the bowing of the surface causes the strips to spread outwardly in moving between the bowed roller 100 and the path roller 102.

The crease removing roller 103 is a smooth surfaced metallic roller, friction driven from the turret rewind unit ensuring that creases in the web are spread out before the webs are wound up.

TURRET REWIND UNIT

The turret rewind unit 24 comprises a turret which is rotatable about a horizontal axis and it is provided with four horizontal spindles off set from said axis two of which serve as take-up rolls, and the other two of which serve as guide rolls. The take-up rolls are diametrically opposite. The turret rewind unit is a flying splice type unit insofar as it enables the winding up of the web material strips continously on the respective take-up spindles without having to stop the machine. This is achieved by winding the strips onto the first take-up spindle, this being driven to effect the winding up of the strips. When the take-up spindle is almost full, the turret changes position so that the strip material passes over one of the guide rollers, and the other take-up spindle comes into tangential contact with the travelling material. A chopping knife then comes into operational relationship with the other take-up spindle cutting the travelling web, and at the same time the second take up spindle is driven so that the free ends of the travelling web wrap round the second take-up spindle and the winding operation continues until the second take-up spindle is full when the turret again moves. The take-up spindles are wound with tension control whilst winding thereon is taking place.

SILICONE REWIND UNIT

Figure 13:
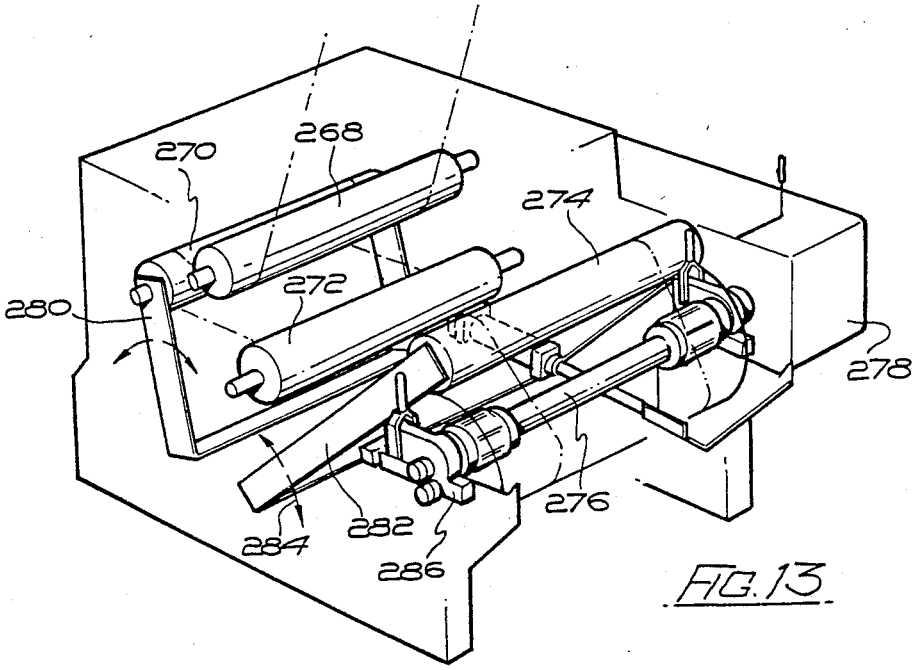
FIG. 13 is a perspective view illustrating a rewind unit.

The silicone rewind unit shown in FIG. 13 is used only when the machine operates in the FIG. 15 (transfer coating) or FIG. 16 (laminated) mode of operation, and the web which is rewound on the unit as shown in FIG. 13, travels under a path roller 268, over a tension roller 270, under a path roller 272, under a lay-on roller 274, and then on to the rewind shaft 276 which is braked by means of a pneumatic brake 278. The rewind shaft is of course driven in order to take up the material being wound. The tension roller 270 is mounted on a swingable yoke 280 depending upon the tension in the web being wound, and a signal from the yoke 280 indicating the tension of the web causes the alteration of the setting of the pneumatic brake in order to control the braking effort whereby the variation of the tension can be compensated. The lay-on roller 274 simply rests by gravity on the material which has been wound on the spindle 276, but it is carried also by a yoke 282 which is pivotable as indicated by arrows 284 to enable the lay-on roller to move away from the axis of spindle 276 as the amount of material wound on the rewind shaft increases.

To facilitate unloading of the rewind shaft 276 and the material thereon, a quick release coupling 286 is fitted between the drive and the shaft 276.

Figure 12:
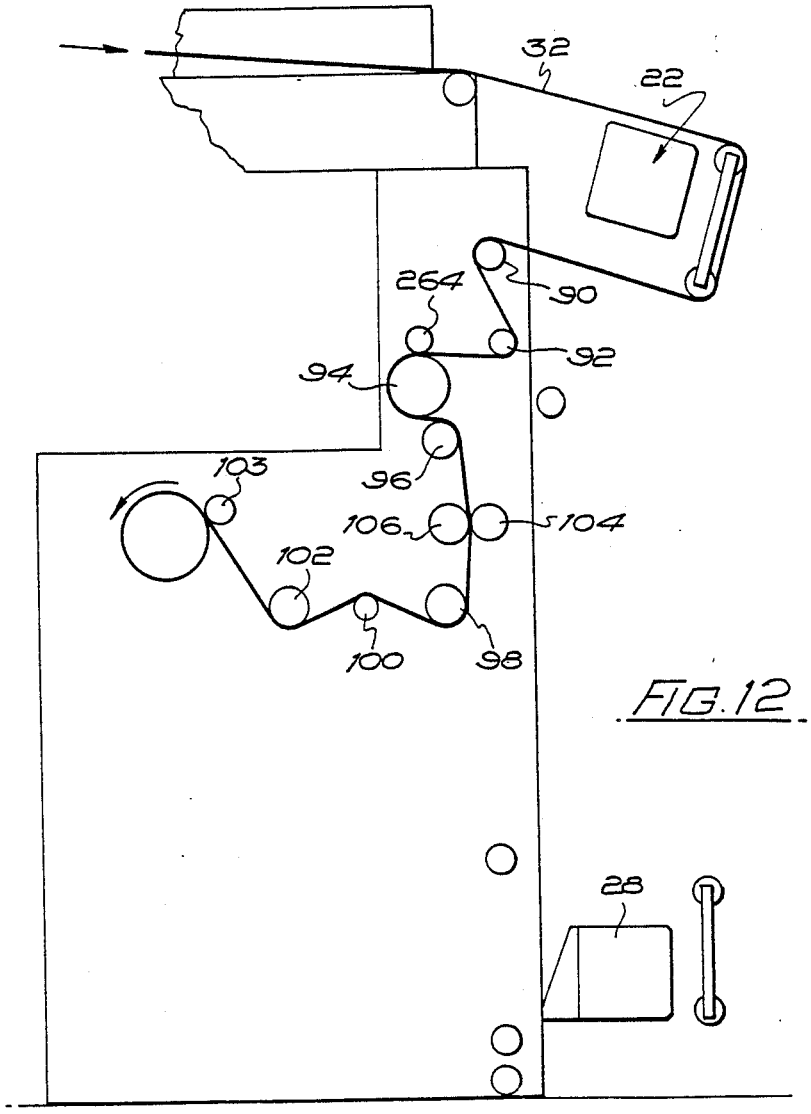
FIG. 12 is a side view of that part of the machine shown in FIG. 1 illustrating the end rollers at the rewind end of the machine.

In the FIG. 15 mode of operation of the machine, the base material 32 of paper or the like follows the same path as the material 32 in FIG. 2 until roller 68 is reached, whereafter the base material 32 is traversed along the bottom side of the machine, being guided by path rollers 290, 292, 294, 296 and 298 until it reaches the edge guide unit 28. From this edge guide unit it passes over path rollers 300, 302, and eventually it is fed into the nip in the end rollers defined by rollers 264 and 94 (see FIG. 12) along with a carrier web of release material 304 which is unwound from the single reel unwind unit 26 and passes through the adhesive applicator unit 18 and the dryer 20.

As the laminated web pass through the end roller drive arrangements 94, 96 and 264 as shown in FIG. 15, the base material continues through the slitting rollers 104 and 106, but the carrier web is deflected away from the slitter rollers over path rollers 306 and 308 and eventually to the silicone rewind unit 30. At the roller pair 94, 96, the adhesive applied to the release web 304 is transferred to the side of the base material 32 opposite to that to which the silicone has been applied at the silicone coating unit 14.

The web 32 is led from slitters 104, 106 round roller 98, but then as distinct from the FIG. 2 layout, under roller 100, over roller 102 and wound in reverse on the turret rewind unit 24, which is indexed in the opposite direction from that in which it is indexed when in the FIG. 2 mode. For the machine to operate in the laminated mode of operation as shown in FIG. 16, the base material 32 travels in the same path as it does in mode FIG. 15 until it reaches the end roller 96 from whence it travels, laminated with the release web 304 (which also travels in the same path as it does in FIG. 15) over the path rollers 306 and 308, and the laminated material is eventually wound in the silicone rewind unit.

CONTROL SYSTEM

In all major operations, control is exercised on the web movement and the following functions are controlled automatically.

1. Web tracking
2. Web tension
3. Line Speed

The web tracking is controlled as explained in relation to FIG. 11 by the edge guide units.

The web tension control is effected by a master control unit 310 as shown in FIG. 14. Line tension is determined by the difference between the speeds of the master nip rollers 94, 96 and of the coating rollers 50, 108 in the silicone coating unit. (To maintain tension, the coating rollers run slower than the master nip rollers). The Master Control Unit 310 regulates the difference in speed as follows:

Line speed is determined by the speed of the master nip rollers, and is selected by means of the controls on the main control desk. Two tacho-generators, one 312 fitted to the drive of the master nip rollers and the other 314 fitted to the drive of the coating rollers, sense the speed of the associated rollers and send speed signals to the unit 310.

Line tension is selected by means of the control on a local control panel mounted on the silicone coating unit. Line tension is sensed by the roller 54 fitted above the silicone coating unit. This roller 54 is mounted on load cells which produce a signal proportional to web tension.

The unit 310 compares the tension setting signal from the local control panel with the line tension signal from the sensing roller 54 and determines the speed difference required to maintain the selected tension. By comparing the actual speed of the coating rollers with the speed of the master nip rollers, the unit 310 determines the speed of the coating rollers required to maintain the selected line tension, and regulates the roller speed accordingly.

The control system fitted to the unwind and rewind units to regulate the tension of the web as it is unwound and rewound are independent of the master control unit 310.

As explained each unit contains a pneumatic tension roller. The roller is carried in a pivoted frame, and an air cylinder exerts a force on the frame to create tension in the web.

The tension in each unit is regulated as follows:

Unwind Units:

The pressure of the air supply to the cylinder can be regulated manually on the unwind control unit; this adjusting of the air supply increases or decreases the breaking effect on the unwind shaft thus adjusting tension.

Rewind Units:

A potentiometer connected to the frame produces a signal proportional to the roller deflection, this signal regulates the speed of the rewind drive motor.

The pressure of the air supply to the roller can be regulated manually to adjust tension.

The web tracking control as described is also independent of the master control unit.

It can be seen that the machine provides equipment for the effective coating of opposite sides of a base material web with a silicone coating and pressure sensitive adhesive, in the case of the FIG. 2 mode of operation, but is also equipped for the performing of alternative modes as indicated in FIGS. 15 and 16 wherein transfer coating takes place or where laminating of a release web and a base material web takes place.

The various aspects of the invention as highlighted herein are not to be considered as limiting the applicant's right to make claim to any novel feature or combination of features or method step or method steps as disclosed herein.

I claim:

1. A method for the continuous coating of base material webs, such as paper or other fibrous webs whose tensile strength is reduced when wet, with adhesive in liquid form comprising the steps of:

(i) unwinding a roll of base material web;

(ii) guiding the web through a coating machine;

(iii) applying, by means of adhesive application means of said coating machine, adhesive in liquid form as a film to one side of the base material web as it moves through the coating machine;

(iv) passing the coated web with the adhesive exposed through a drying machine;

(v) sensing the speed of at least one roller over which the web travels;

(vi) automatically controlling the tension in the web as it passes through the coating machine in response to said sensing to prevent the tension from exceeding a preset maximum to ensure that any weakening in the tensile strength of the web as a result of the application thereto of the liquid adhesive will not lead to breakage of the web; and (vii) rewinding the coated web into roll form.

2. A method according to claim 1, wherein the tension control is effected by means of a movable roller having load sensors coupled thereto so that when the tension in the web increases above a predetermined level, the load sensors will indicate this and cause the roller to be displaced in a direction reducing the tension in the web, and vice versa.

3. A method according to claim 1 or claim 2, wherein the tension occurs is upstream of an applicator station of the machine.

* * * * *